US010408039B2

(12) United States Patent
Saldanha et al.

(10) Patent No.: US 10,408,039 B2
(45) Date of Patent: Sep. 10, 2019

(54) CONNECTING A TRANSDUCER TO A CABLE WITHOUT PHYSICALLY SEVERING THE CABLE

(71) Applicant: Halliburton Energy Services, Inc., Houston, TX (US)

(72) Inventors: Savio Saldanha, Spring, TX (US); Matthew Scogin, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 15/525,356

(22) PCT Filed: Jan. 4, 2016

(86) PCT No.: PCT/US2016/012022
§ 371 (c)(1),
(2) Date: May 9, 2017

(87) PCT Pub. No.: WO2017/119864
PCT Pub. Date: Jul. 13, 2017

(65) Prior Publication Data
US 2018/0112513 A1 Apr. 26, 2018

(51) Int. Cl.
*E21B 47/01* (2012.01)
*E21B 17/00* (2006.01)
*E21B 47/12* (2012.01)

(52) U.S. Cl.
CPC ..... *E21B 47/011* (2013.01); *E21B 17/00* (2013.01); *E21B 47/12* (2013.01)

(58) Field of Classification Search
CPC ..... E21B 47/011; E21B 17/00; E21B 17/028; E21B 17/023
See application file for complete search history.

(56) References Cited

U.S. PATENT DOCUMENTS

| | | | |
|---|---|---|---|
| 3,128,532 | A | 4/1964 | Frank |
| 3,453,711 | A | 7/1969 | Miller |
| 4,850,895 | A | 7/1989 | Arai et al. |
| 4,972,839 | A | 11/1990 | Angelsen |
| 5,048,531 | A | 9/1991 | Spotts et al. |
| 5,171,162 | A | 12/1992 | Kaufman |
| 5,172,717 | A | 12/1992 | Boyle et al. |
| 5,203,721 | A | 4/1993 | Buck |
| 5,259,791 | A | 11/1993 | Buck |

(Continued)

OTHER PUBLICATIONS

International Searching Authority, International Search Report and Written Opinion, International application No. PCT/US2016/012022, entire document, which is a PCT parent to the instant application, dated Sep. 12, 2016.

(Continued)

*Primary Examiner* — David J Bagnell
*Assistant Examiner* — Manuel C Portocarrero
(74) *Attorney, Agent, or Firm* — Howard L. Speight, PLLC

(57) ABSTRACT

A portion is sectioned from an outer jacket of a cable. The sectioned portion exposes an insulator layer within the outer jacket. The cable includes a conduit within the insulator layer. The insulator layer in the sectioned portion is pierced with a terminal to contact the conduit. A transducer is connected to the terminal. The housing is sealed to the cable around the transducer and the terminal.

15 Claims, 6 Drawing Sheets

(56) References Cited

U.S. PATENT DOCUMENTS

| | | | | |
|---|---|---|---|---|
| 5,410,916 | A | 5/1995 | Cook | |
| 5,445,535 | A | 8/1995 | Phillips et al. | |
| 5,555,619 | A | 9/1996 | Maggio et al. | |
| 5,931,684 | A | 8/1999 | Obendorf et al. | |
| 5,945,634 | A | 8/1999 | Shimirak et al. | |
| 7,479,878 | B2 | 1/2009 | Maki et al. | |
| 8,146,658 | B2 | 4/2012 | Howard et al. | |
| 8,263,851 | B2 | 9/2012 | Barbera | |
| 8,403,859 | B2 | 3/2013 | Abraham | |
| 8,757,276 | B2 | 6/2014 | Alff et al. | |
| 9,045,970 | B1 * | 6/2015 | Riley, Jr. | E21B 47/011 |
| 9,121,962 | B2 | 9/2015 | Madhavan et al. | |
| 2004/0067683 | A1 | 4/2004 | Gehrke et al. | |
| 2005/0194184 | A1 | 9/2005 | Gleitman | |
| 2006/0035481 | A1 | 2/2006 | Petersen et al. | |
| 2009/0318003 | A1 | 12/2009 | Hossack et al. | |
| 2010/0156244 | A1 | 6/2010 | Lukacs et al. | |
| 2011/0024105 | A1 * | 2/2011 | Hammer | E21B 34/14<br>166/113 |
| 2014/0367092 | A1 | 12/2014 | Roberson et al. | |
| 2015/0209828 | A1 | 7/2015 | Betz | |
| 2016/0265344 | A1 * | 9/2016 | Hornsby | E21B 47/00 |

OTHER PUBLICATIONS

International Preliminary Examining Authority, International Preliminary Report on Patentability, International Application No. PCT/US16/12022, which is the PCT parent of the instant application, dated Jul. 10, 2018.

Ketterling, Jeffrey A., Aristizabal, Orlando, Turnbull, Daniel H., Lizzi, Frederic L., Design and Fabrication of a 40-MHz Annular Array Transducer, IEEE Transactions on Ultrasonics, Ferroelectrics, and Frequency Control, vol. 52, No. 4, Apr. 2005.

* cited by examiner

CONNECTING A TRANSDUCER TO A CABLE WITHOUT PHYSICALLY SEVERING THE CABLE

BACKGROUND

In an oilfield, a borehole is drilled for the production of hydrocarbons. Sensors may be placed along a tubular, such as a casing, placed in the borehole to measure parameters, such as temperature and pressure, along the borehole. The sensors may be coupled to a cable to carry signals between the sensors and processing equipment. Attaching sensors to such a cable without severing the cable is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Further, while this disclosure describes a land-based production system, it will be understood that the equipment and techniques described herein are applicable in sea-based systems, multi-lateral wells, all types of production systems, all types of rigs, measurement while drilling ("MWD")/logging while drilling ("LWD") environments, wired drill-pipe environments, coiled tubing (wired and unwired) environments, wireline environments, and similar environments.

The disclosed equipment is best understood in the context of the larger systems in which it operates.

Figure 1:
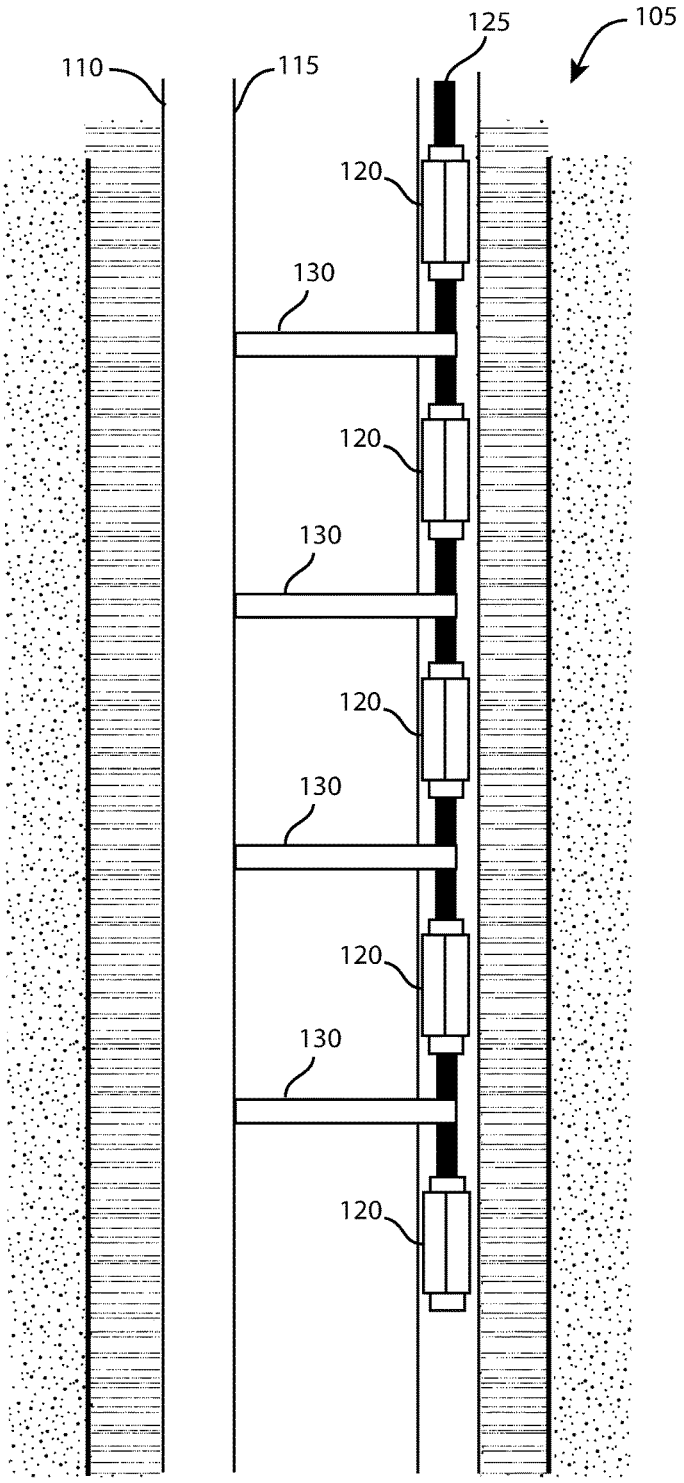
FIG. 1 is an elevation of an oil well.

FIG. 1 is an elevation of an oil well 105. The oil well 105 includes a casing 110 and a production tubing 115. The casing 110 may include a conductor casing, a surface casing, an intermediate casing, a production liner or any combination thereof. The production tubing 115 may include a series of tubular sections (individual sections are not shown), which can be connected end to end. The production tubing 115 is the medium that transports gas and oil from the reservoir to the surface (not shown).

Before the production tubing 115 is assembled (i.e., by connecting the tubular sections end to end) and placed in the oil well 105 (to begin the extraction of oil and gas), one or more sensor modules 120 are coupled to a cable 125. The cable 125 with the attached sensor modules 120 are then coupled to the production tubing 115 using one or more holders 130, which may be clamps, straps or another similar fasteners. Instead of being coupled to the production tubing 115, the cable 125 and sensor modules 120 may be coupled to the casing 110 or to a screen (e.g. a sand control screen, not shown).

The production tubing 115 with the sensor modules 120 and cables 125 attached is then placed in the oil well 105. The process of coupling the sensor modules 120, cable 125 and holders 130 to the production tubing 115 is repeated until the production tubing 115 reaches a predetermined desired depth within the oil well 105.

The cable 125 is a medium useful to transmit data and/or power as needed for a desired well application. The cable 125 may be used to carry signals to and/or from a variety of devices and/or locations in the oil well 105 or on the surface.

The sensor modules 120 measure, monitor, gather and report a variety of parameters, such as temperature and pressure, within the oil well 105. Data from the sensor modules 120 can be used by a processor (not shown) in the oil well 105 or on the surface to provide data regarding the oil well 105. In addition, the sensor modules 120 may receive power from the cable 125.

Figure 2:
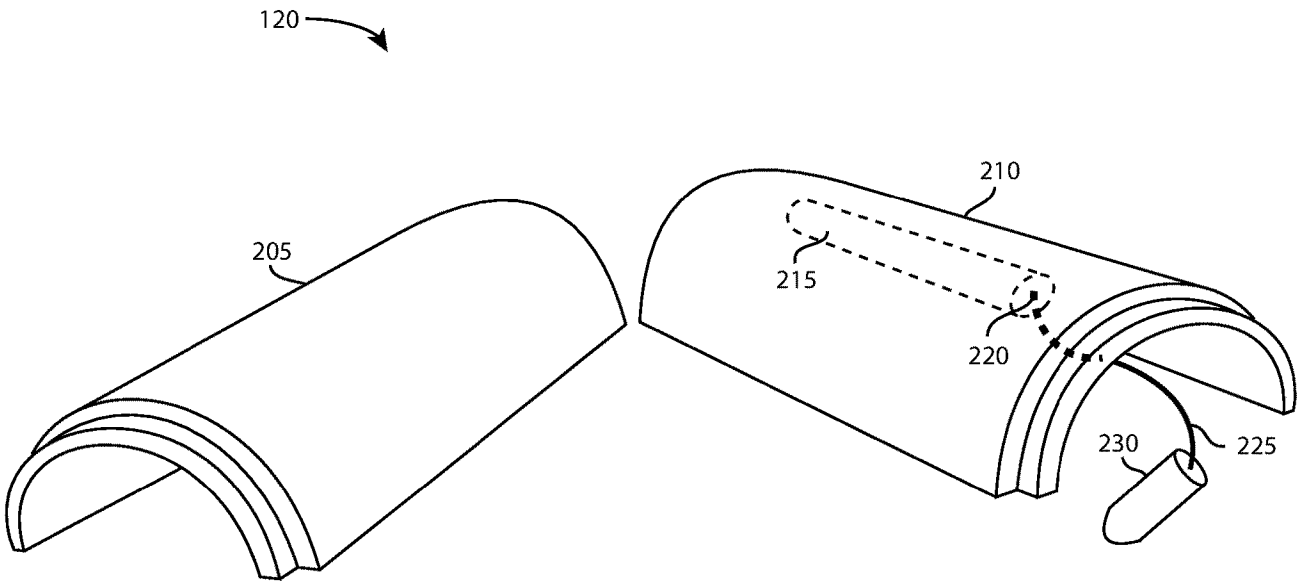
FIG. 2 is a perspective view of a sensor module kit.

FIG. 2 is a perspective view of a sensor module 120 kit, which is how the sensor module 120 may be delivered. The sensor model 120 may be delivered in a fully assembled form.

The sensor module 120 has a first section 205 and a second section 210, which together make up a housing. The sensor module 120 is divided into sections 205 and 210 to allow the sensor module 120 to be assembled around and securely coupled to the cable 125 (as will be discussed below in connection with FIGS. 4 and 5) without the need to sever the cable 125.

The first section 205 may be coupled to the second section 210 forming a channel to allow passage of the cable 125 (as discussed below in connection with FIGS. 4 and 5). The first section 205 and the second section 210 may be integral with each other, which would require slipping the sensor module 120 over the end of the cable 125.

The first section 205 and the second section 210 are sealable to the cable 125, where "sealable" is defined to mean coupled to prevent the incursion of fluids (such as water, oxygen, or any other fluid that might cause corrosion or harm to the sensor module 120) into a volume formed between the first section 205, second section 210, and cable 125 (discussed below in connection with FIG. 5). The first section 205 and the second section 210 may be clamshell halves, hollow half cylinders, or they may have non-cylindrical shapes.

The first section 205 and second section 210 may be welded together using, for example, laser welding or arc welding, or they may be coupled together using any other suitable technique including the use of adhesives, such as glue or epoxies, or the use of mechanical couplings such as bolts, bands, or clips made from metal, plastic, or any other suitable material.

A transducer 215 is coupled to the first section 205 or the second section 210 using an adhesive or another coupling technique. The transducer 215 may convert one form of energy to another form of energy. For example, the transducer 215 may convert electrical, mechanical, electromagnetic, chemical, acoustic and/or thermal energy to a signal. The transducer 215 may include a receiver (i.e. antenna) or data collection device to receive such energy. The transducer 215 may include a processor (not shown) to process received data and commands or to prepare data for delivery to the surface. The transducer 215 may include an electronic storage device (not shown), such as a memory, for storage of data used or generated by the processor.

The transducer 215 includes a signal port 220 by which the signal produced by the transducer 215 can be accessed. The signal port 220 is coupled to a signal conductor 225, such as a wire, which, in turn, is coupled to a terminal 230. The terminal 230 is the point by which the data from the transducer 215 is transferred to the cable 125 (as discussed below in connection with FIGS. 4 and 5) or by which power is provided from the cable 125 to the transducer 215. The transducer 215, signal port 220, signal conductor 225 and terminal 230 may be coupled to the first section or to the second section 210. The first section 205 and second section 210 protect the transducer 215, the signal port 220, and terminal 230 from corrosion or other harm.

Figure 3:
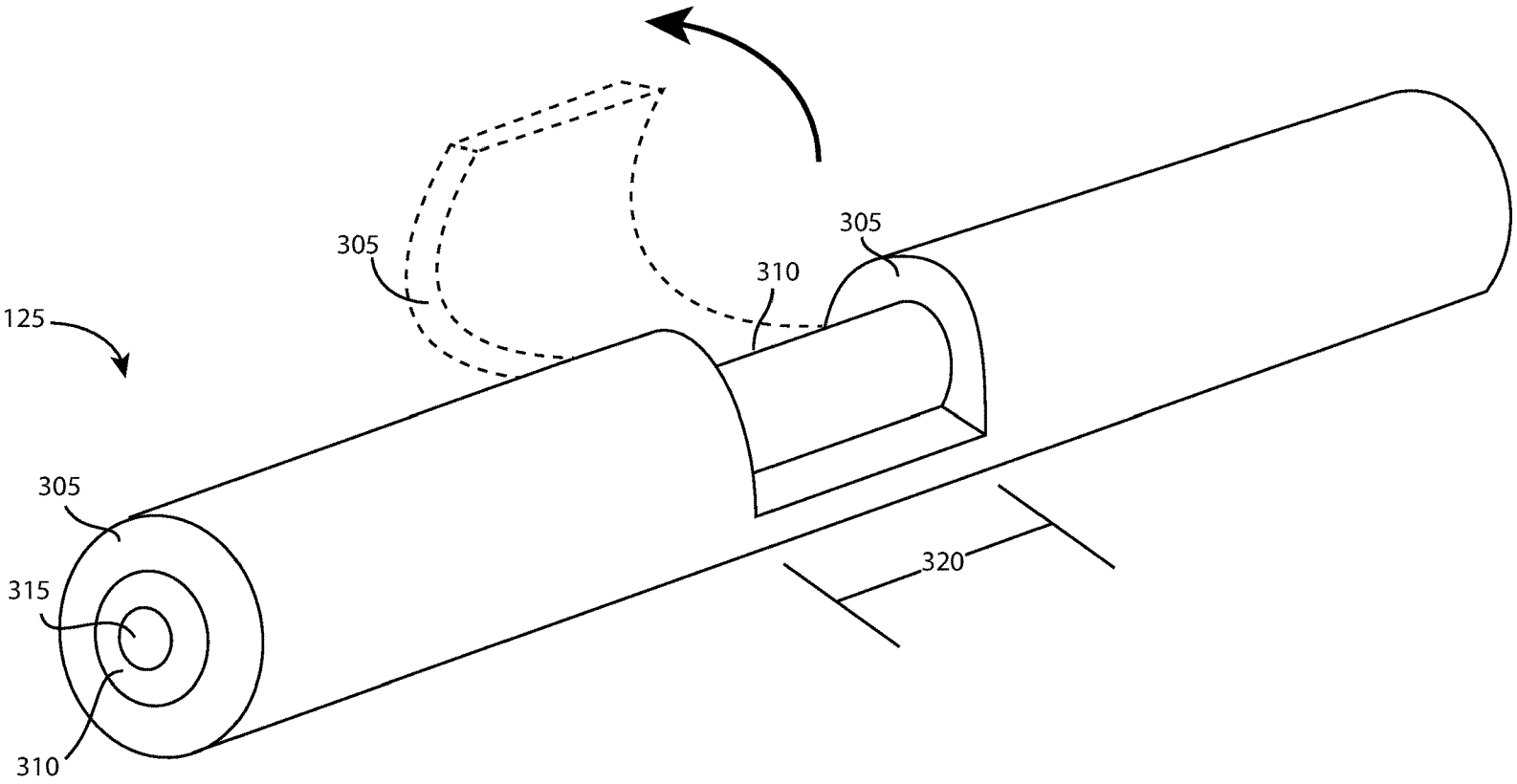
FIG. 3 is a perspective view of tubing encapsulated cable (TEC) with a sectioned portion.

FIG. 3 is a perspective view of tubing encapsulated cable (TEC) 125 with a sectioned portion. The cable 125 may be a tubing encapsulated cable (TEC), a coaxial cable, or another suitable cable type. The cable 125 may be armored cable and it may have multiple conductors.

The cable 125 may have an outer jacket 305. The outer jacket 305 may be a corrosion-resistant metallic conduit. The cable 125 may have an insulator layer 310, such as a non-metallic sheath, that encloses and protects the insulator layer 310. The cable 125 may have a conduit 315 that is enclosed and protected by the insulator layer 310 and the outer jacket 305. The conduit 315 may be a metallic.

In the process of coupling the sensor module 120 to the cable 125, a portion 320 of the outer jacket 305 may be sectioned to expose the insulator layer 310 (illustrated by the arrow on FIG. 3). Sectioning the outer jacket 305, rather than severing the cable 125, preserves the structural and electrical integrity of the cable 125, reducing the possibility that the cable will break or lose the ability to carry data because of the attachment of the sensor module 120.

Figure 4:
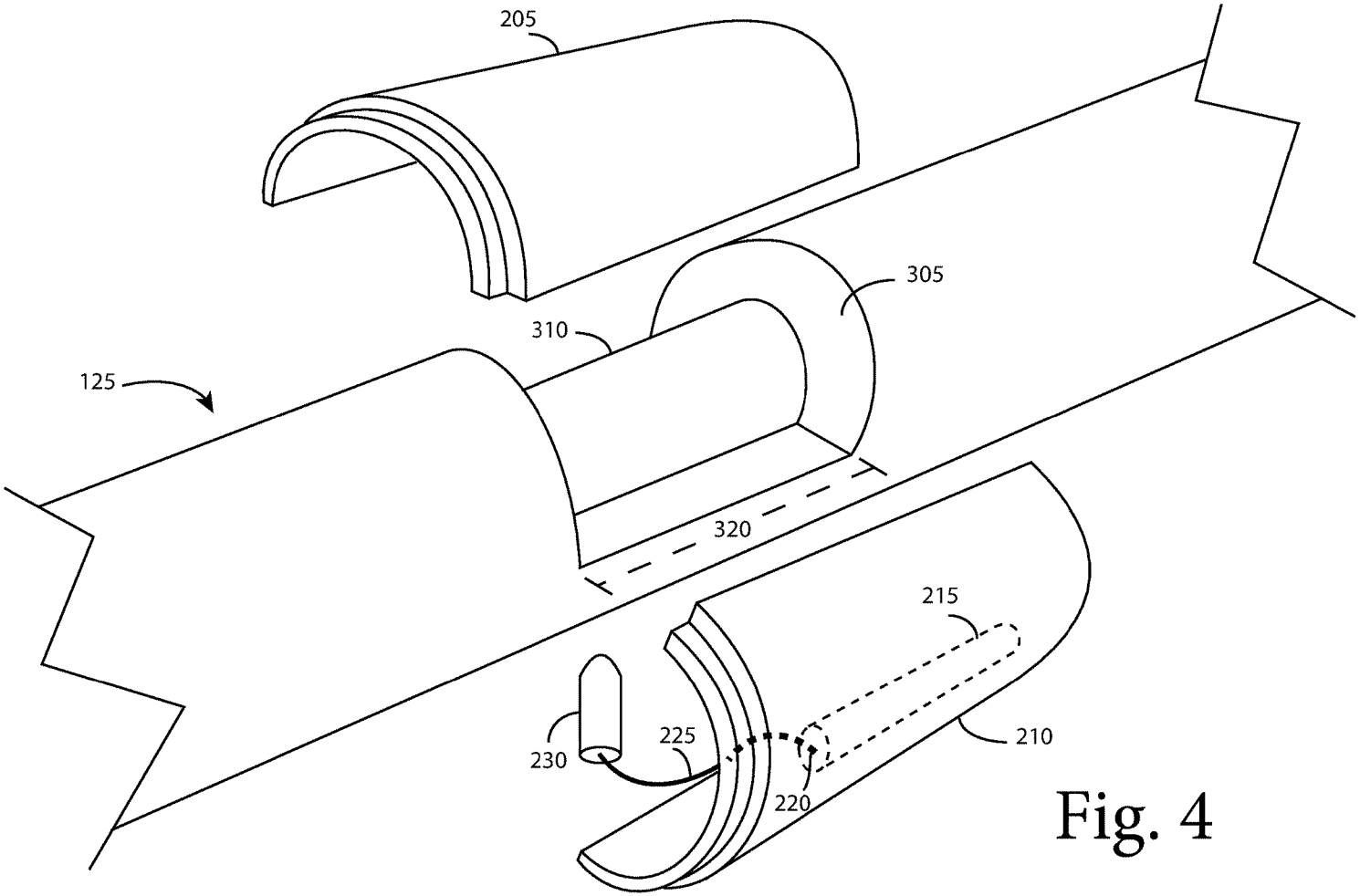
FIG. 4 is a perspective view showing the process of coupling a sensor module to a cable.
Figure 5:
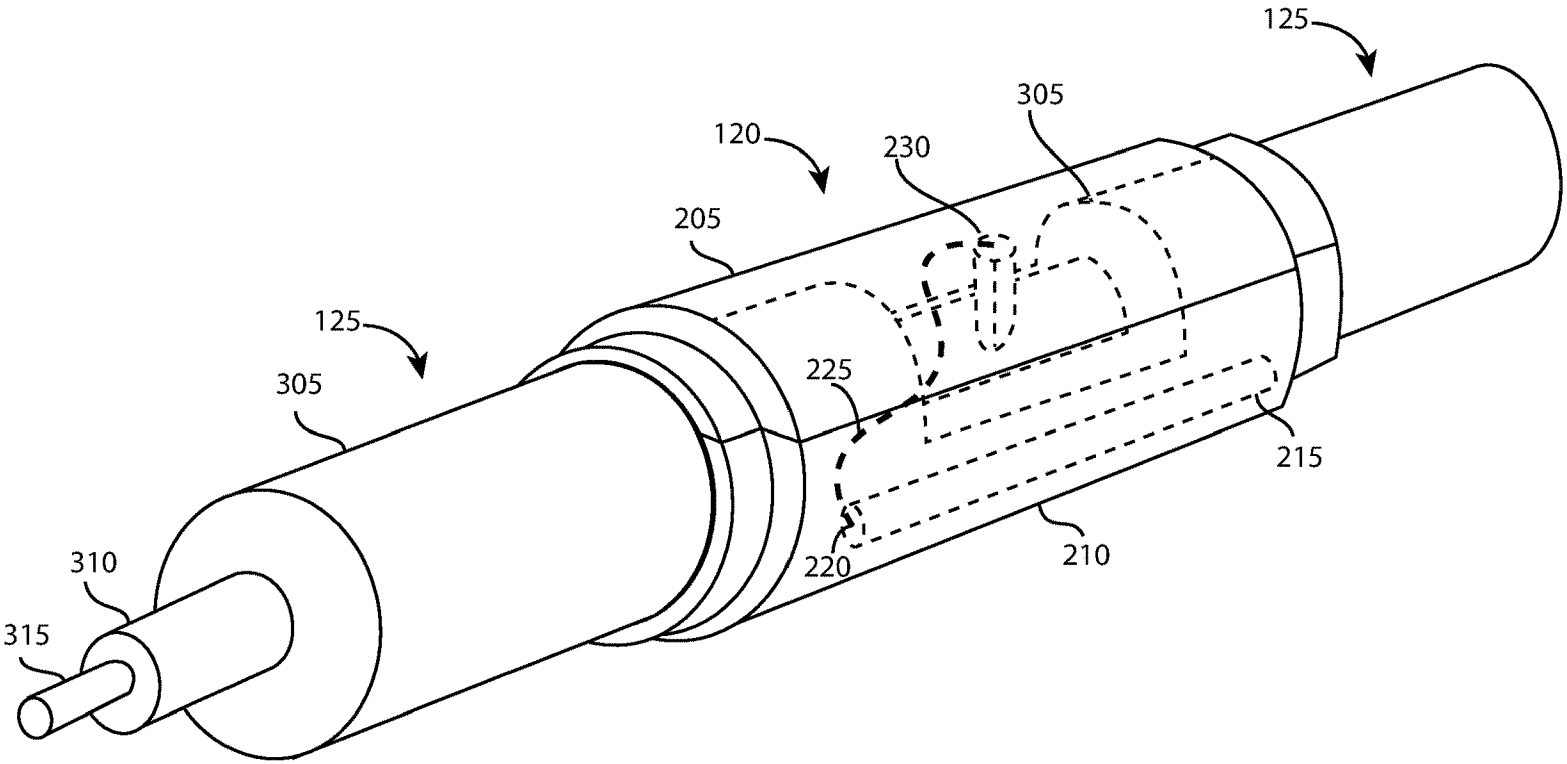
FIG. 5 is a perspective view showing a sensor module coupled to a cable.

FIG. 4 is a perspective view showing the process of coupling a sensor module 120 to a cable 125 and FIG. 5 is a perspective view showing the sensor module 120 coupled to the TEC 125. The process begins by sectioning a portion 320 of the outer jacket 305 to expose the insulator layer 310. Sectioning can be done by slicing, cutting, burning, melting, abrading, or any other process that exposes the insulator layer 310 while not severing the cable 125. The sectioned portion 320 is sized to fit within the sensor module 120. Alternatively, the outer jacket 305 may not be sectioned, thereby keeping the insulator layer 310 unexposed (not shown).

The terminal 230 is then coupled to the conduit 315 by penetrating the insulator layer 310 exposed in the sectioning to make electrical contact with the conduit 315 or, if the cable has not been sectioned, by penetrating the outer jacket 305 and the insulator layer 310 to make electrical contact with the conduit 315. The terminal 230 is designed to facilitate penetration of the insulator layer 310 and/or the outer jacket 305 and engagement with the conduit 315. The terminal 230 may be manufactured from a hardened conductive metal, such as steel, and may be pointed to facilitate penetration.

Figure 6:
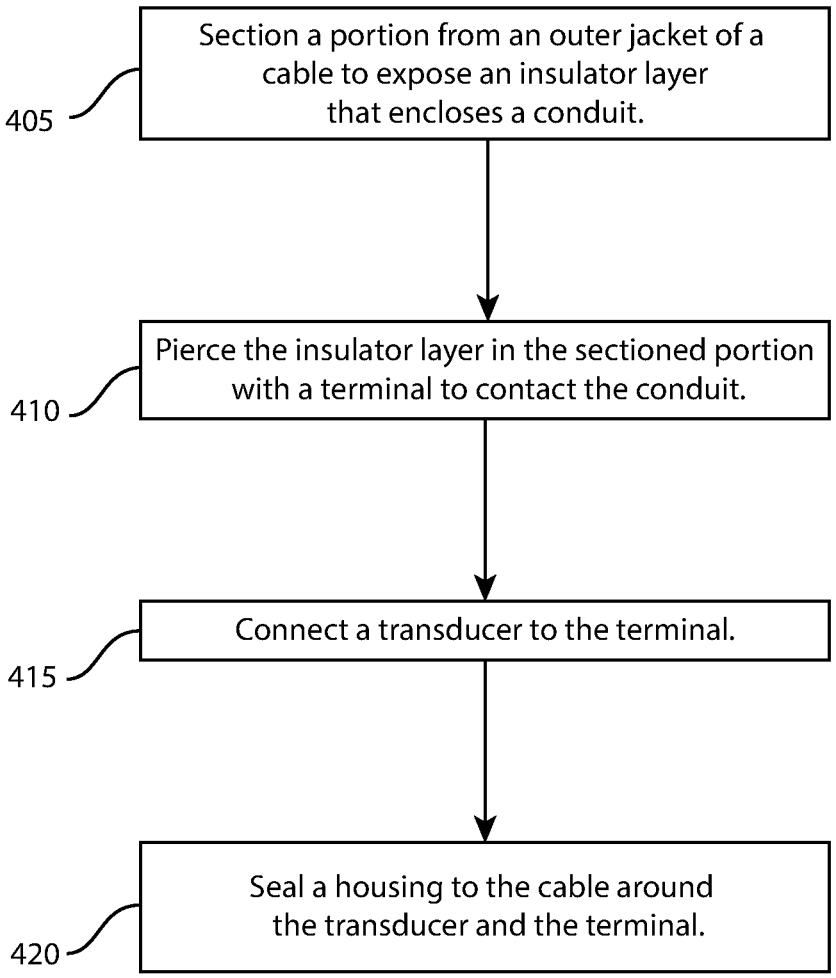
FIG. 6 is a flow chart for assembling a sensor module to a cable.

In use, illustrated in FIG. 6, a portion (such as sectioned portion 320) is section from an outer jacket (such as outer jacket 305) of a cable (such as cable 125) to expose an insulator layer (such as insulator layer 310) that encloses a conduit (such as conduit 315) within the insulator layer (such as insulator layer 310) (block 405). In or more embodiments, a terminal (such as terminal 230) pierces the insulator (such as insulator layer 310) in the sectioned portion to make contact with the conduit (such as conduit 315) (block 410). In one or more embodiments, a transducer (such as transducer 215) is connected to the terminal (such as terminal 230) (block 415). In one or more embodiments, a housing (such as first section 205 and second section 210) is sealed to the conduit (such as conduit 315) around the transducer (such as transducer 215) and the terminal (such as terminal 230) (block 420).

In one aspect, method includes sectioning a portion from an outer jacket of a cable to expose an insulator layer within the outer jacket. The cable includes a conduit within the insulator layer. The method include piercing the insulator layer in the sectioned portion with a terminal to contact the conduit. The method includes connecting a transducer to the terminal. The method includes sealing a housing to the cable around the transducer and the terminal.

Implementations may include one or more of the following. The housing may include two sections. Sealing the housing to the cable may include welding the two sections to each other and to the outer jacket of the cable. Sectioning the portion may include removing a section of the outer jacket of the cable, wherein the section is sized to fit within the sensor module. Sealing the housing to the cable may include covering the sectioned portion with the housing. The method may include coupling the housing to a tubing.

In one aspect, an apparatus includes a sensor module having a first section, and a second section couplable with the first section and couplable to a cable and sealable to the cable. A transducer is coupled to the sensor module. The transducer has a signal port. A signal conductor is coupled to the signal port of the transducer. A terminal is coupled to the signal conductor. The terminal is capable of penetrating an insulator layer of the cable after an outer jacket of the cable is sectioned to produce a sectioned portion of the cable.

Implementations may include one or more of the following. The sectioned portion of the cable, the signal conductor, and the signal port may be sealable by the sensor module. The first section and the second section may be weldable together to form the sensor module.

In one aspect, an apparatus includes a cable having an outer jacket, an insulator layer within the outer jacket, and a conduit within the insulator layer. A portion of the cable is sectioned to expose the insulator layer. The apparatus includes a sensor module having a first section and a second section coupled to the first section and coupled and sealed to the outer jacket of the cable over the sectioned portion of the outer jacket. The apparatus includes a transducer mounted within the sensor module. The transducer has a signal port. The apparatus includes a signal conductor coupled to the signal port of the transducer. The apparatus includes a terminal coupled to the signal conductor. The terminal penetrates the insulator layer of the cable in the sectioned portion of the outer jacket.

Implementations may include one or more of the following. The sectioned portion of the cable, the signal conductor, and the signal port may be sealed by the sensor module. The first section and the second section may be welded together to form the sensor module.

In one aspect, a system includes a tubing and a cable coupled to the tubing. The cable has an outer jacket, an insulator layer within the outer jacket, and a conduit within the insulator layer. A portion of the cable is sectioned to expose the insulator layer. The system further includes a sensor module having a first section and a second section coupled to the first section and coupled and sealed to the outer jacket of the cable over the sectioned portion of the outer jacket. The system further includes a transducer mounted within the sensor module. The transducer has a signal port. The system further includes a signal conductor coupled to the signal port of the transducer. The system further includes a terminal coupled to the signal conductor. The terminal penetrates the insulator layer of the cable in the sectioned portion of the outer jacket.

Implementations may include one or more of the following. The tubing may include a production tubing. The tubing may include a casing.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

One or more figures show block diagrams of systems and apparatus for a production system, in accordance with one or more embodiments. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method for coupling a transducer to a downhole device to be placed in an oil well comprising:

sectioning a portion from an outer jacket of a cable to expose an insulator layer within the outer jacket, wherein the cable includes a conduit within the insulator layer;

piercing the insulator layer in the sectioned portion with a terminal to contact the conduit;

connecting the transducer to the terminal;

sealing a housing to the cable around the transducer and the terminal, wherein the terminal is not directly connected to the housing;

with the housing sealed to the cable, coupling the cable to the downhole device; and placing the transducer, the terminal, the cable, and the downhole device in the oil well.

2. The method of claim 1 wherein the housing comprises two sections.

3. The method of claim 2 wherein sealing the housing to the cable comprises welding the two sections to each other and to the outer jacket of the cable.

4. The method of claim 1 wherein sectioning the portion comprises removing a section of the outer jacket of the cable, wherein the removed section is sized to fit within the housing.

5. The method of claim 1 wherein sealing the housing to the cable comprises covering the sectioned portion with the housing.

6. The method of claim 1 wherein the downhole device comprises a tubing.

7. An apparatus comprising:

a sensor module having:

a first section, and a second section couplable with the first section and couplable to a cable and sealable to the cable;

a transducer coupled to the sensor module, the transducer having a signal port;

a signal conductor coupled to the signal port of the transducer;

a terminal coupled to the signal conductor, wherein the terminal is capable of penetrating an insulator layer of the cable after an outer jacket of the cable is sectioned to produce a sectioned portion of the cable, wherein, with the sensor module coupled to the cable, the cable is couplable to a downhole device and wherein the terminal is not directly connected to the sensor module.

8. The apparatus of claim 7 wherein the sectioned portion of the cable, the signal conductor, and the signal port are sealable by the sensor module.

9. The apparatus of claim 7 wherein the first section and the second section are weldable together to form the sensor module.

10. An apparatus comprising:

a downhole device to be placed in an oil well;

a cable coupled to the downhole device, the cable having:

an outer jacket, an insulator layer within the outer jacket, and a conduit within the insulator layer, wherein a portion of the cable is sectioned to expose the insulator layer;

a sensor module having:

a first section, and a second section coupled to the first section and coupled and sealed to the outer jacket of the cable over the sectioned portion of the outer jacket;

a transducer mounted within the sensor module, the transducer having a signal port;

a signal conductor coupled to the signal port of the transducer; and a terminal coupled to the signal conductor, wherein the terminal penetrates the insulator layer of the cable in the sectioned portion of the outer jacket and wherein the terminal is not directly connected to the sensor module.

11. The apparatus of claim 10 wherein the sectioned portion of the cable, the signal conductor, and the signal port are sealed by the sensor module.

12. The apparatus of claim 10 wherein the first section and the second section are welded together to form the sensor module.

13. A system comprising:

a downhole device to be placed in an oil well;

a cable coupled to the downhole device, the cable having:

an outer jacket, an insulator layer within the outer jacket, and a conduit within the insulator layer, wherein a portion of the cable is sectioned to expose the insulator layer;

a sensor module having:

a first section, and a second section coupled to the first section and coupled and sealed to the outer jacket of the cable over the sectioned portion of the outer jacket;

a transducer mounted within the sensor module, the transducer having a signal port;

a signal conductor coupled to the signal port of the transducer; and a terminal coupled to the signal conductor, wherein the terminal penetrates the insulator layer of the cable in the sectioned portion of the outer jacket and wherein the second section is electrically disconnected from the terminal.

14. The system of claim 13 wherein the downhole device comprises a production tubing.

15. The system of claim 13 wherein the downhole device comprises a casing.

* * * * *